US005302099A

United States Patent [19]

Serafini

[11] Patent Number: 5,302,099

[45] Date of Patent: Apr. 12, 1994

[54] LAMINATED FABRIC USEFUL AS A CONCRETE FORM LINER

[75] Inventor: Franco L. Serafini, Leudelange, Luxembourg

[73] Assignee: E. I. Du Pont de Nemours and Company, Wilmington, Del.

[21] Appl. No.: 952,117

[22] Filed: Sep. 28, 1992

[51] Int. Cl.[5] ..... B28B 1/26; B28B 7/36

[52] U.S. Cl. ..... 425/84; 249/113; 249/134; 249/141; 249/189; 264/86

[58] Field of Search ..... 249/113, 134, 135, 141, 249/189; 264/86, 87, 219; 425/84, 85; 29/448, 449

[56] References Cited

U.S. PATENT DOCUMENTS

| | | | |
|---|---|---|---|
| 2,310,391 | 2/1943 | Brooks et al. | 249/114.1 |
| 2,432,002 | 12/1947 | Frederick et al. | 154/45.9 |
| 2,628,402 | 2/1953 | Billner | 264/87 |
| 2,671,940 | 3/1954 | Billner | 425/85 |
| 2,688,175 | 9/1954 | Billner | 264/87 |
| 3,477,103 | 11/1969 | Troth, Jr. | 19/163 |
| 3,600,771 | 8/1971 | Dyrander | 210/460 |
| 3,726,950 | 4/1973 | Turzillo | 264/32 |
| 3,780,975 | 12/1973 | Turzillo | 249/1 |
| 3,821,062 | 6/1974 | Henderson | 161/59 |
| 3,991,244 | 11/1976 | Debbas | 428/113 |
| 4,162,190 | 7/1979 | Ashworth | 162/359 |
| 4,213,926 | 7/1980 | Toyoda et al. | 264/74 |
| 4,335,065 | 6/1982 | Ando | 264/87 |
| 4,439,273 | 3/1984 | Curry | 162/358 |
| 4,472,339 | 9/1984 | van der Ploeg et al. | 249/113 |
| 4,500,588 | 2/1985 | Lundstrom | 428/212 |
| 4,657,806 | 4/1987 | Dutt | 428/226 |
| 4,730,805 | 3/1988 | Yokota et al. | 249/113 |
| 4,761,326 | 8/1988 | Barnes et al. | 428/219 |
| 4,787,597 | 11/1988 | Yokota et al. | 249/113 |
| 4,815,892 | 3/1989 | Martin | 405/45 |
| 4,851,281 | 7/1989 | Wood | 428/282 |
| 4,856,754 | 8/1989 | Yokota et al. | 249/113 |
| 4,863,792 | 9/1989 | Mrozinski | 428/315.5 |
| 4,877,679 | 10/1989 | Leatherman et al. | 428/224 |
| 4,882,217 | 11/1989 | FitzPatrick | 428/212 |
| 5,124,102 | 6/1992 | Serafini | 264/86 |
| 5,135,692 | 8/1992 | Serafini | 264/86 |

FOREIGN PATENT DOCUMENTS

| | | | |
|---|---|---|---|
| 53441 | 5/1912 | Austria . | |
| 0429730 | 6/1991 | European Pat. Off. . | |
| 1-130907 | 5/1989 | Japan . | |
| 1-198305 | 8/1989 | Japan . | |
| 2-48477 | 2/1990 | Japan . | |
| 2-128802 | 5/1990 | Japan . | |
| 3-251404 | 11/1991 | Japan | 249/114.1 |
| 2156416 | 10/1985 | United Kingdom . | |
| 2158767 | 11/1985 | United Kingdom . | |
| 8909864 | 10/1989 | World Int. Prop. O. . | |

OTHER PUBLICATIONS

"Typar" Report 6, Dam construction on the River Euphrates. A smooth improvement. (Nov. 1988).

IABSE Symposium Report, "Improvement of Surface Quality of Concrete Structures by Unique Formwork", Tanaka et al. Distb.: Paris, FR (Sep. 1987).

Nikkei New Materials, No. 32, pp. 117–120, Aug. 1987 (partial translation row 3, line 9, p. 117 to 1st row, line 9, p. 118).

DuPont "Zemdrain Bulletin" (1990).

Chemical Abstracts vol. 98, No. 6, 1983, Abstract No. 98:39727, "Concrete Molding", p. 306, col. 2.

*Primary Examiner*—Khanh Nguyen

[57] ABSTRACT

Concrete forms utilizing a laminated concrete form liner including a porous fabric laminated to a drainage scrim. The laminated form liner is untensioned and used in combination with a support to form a concrete casting system wherein the porous fabric side of the laminated form liner is placed directly in contact with the concrete. The drainage scrim enhances the ability of the form liner to remove excess water from the surface of the concrete.

8 Claims, 2 Drawing Sheets

LAMINATED FABRIC USEFUL AS A CONCRETE FORM LINER

FIELD OF THE INVENTION

The present invention relates to a laminated concrete form liner and to forms for concrete manufacture which yield relatively smooth concrete surfaces. More particularly, the invention relates to concrete forms utilizing a concrete form liner comprising a porous fabric laminated to a drainage scrim.

BACKGROUND OF THE INVENTION

In the manufacture of concrete, the concrete is usually cast using a form wherein the concrete takes the shape of the form. The wet concrete is poured into or against the concrete form and, upon setting and removal of the form, the newly-exposed concrete surface is a reverse impression of the inner surface of the form. In the case of wooden forms, the concrete takes the appearance of the wood grain; and in the case of forms involving seamed form members, the concrete shows any seams which have not been sufficiently masked.

Air is often added to a concrete mix and water is often added in excess of the amount required for hydration. Such air and water are useful to render the mix flowable and to facilitate handling and pouring. However, the excess water, if left undrained, results in concrete having a weakened surface and, the air, if not removed, results in surface pores as large as 0.1 to 3 cm, which pores leave an uneven surface open to the effects of dirt and erosion by the freezing/thawing cycles of water.

Efforts have been made in the past to overcome these drainage and removal problems. For example, U.S. Pat. Nos. 5,124,102 and 5,135,692 (both to Serafini) disclose porous fabrics useful for allowing excess water and air to pass therethrough but substantially no cement particles. However, under certain circumstances these fabrics have proven to be sensitive to concrete fluidity and excessive concrete compaction and vibration. If conditions are not well controlled, sufficient cement particles will also pass through the porous fabric, collect on the backside of the fabric sheet, prevent further drainage, and thereby provide diminished concrete properties (e.g., white spots). This condition is particularly prevelant when the concrete form is directly vibrated as is necessary in some cases where normal curing won't suffice. Also, when using these prior art porous fabrics, proper fixation and tensioning of the fabric over the form are essential, not to mention time consuming.

With these prior art fabrics, fine concrete particles typically fill the fabric's larger pores, especially if excessive concrete compaction occurs. Usually, if enough fine concrete particles have entered the fabric structure and sufficient concrete curing is allowed, then the separation of the fabric from the cured concrete becomes very difficult or even impossible. This occurs because the concrete particles that have entered the fabric and hardened therein pull the fabric fibers out of the surface of the fabric when the fabric is separated from the concrete. The problem becomes worse when the fabric is reused with loose surface fibers since the loose fibers tend to become embedded in the cured concrete thereby causing delamination of the fabric sheet. The problem is heightened if the fabric is not handled with care during form assembly and disassembly, since mechanical friction (e.g., rubbing) tends to make the fabric fuzzy and causes the loose fibers to stick to the concrete. Multiple use of the fabric causes more of the fabric pores to become plugged by fine concrete particles resulting in greatly reduced levels of water and air evacuation via draining.

Clearly, what is needed is an improved concrete form and concrete form liner which do not have the deficiencies inherent in the prior art. Specifically, the improved form should allow drainage of excess water from the concrete surface but should prevent concrete particles from passing into the form liner and curing therein. In addition, the form should be useable without form liner tensioning. Other objects and advantages of the present invention will become apparent to those skilled in the art upon reference to the attached drawings and to the detailed description of the invention which hereinafter follows.

SUMMARY OF THE INVENTION

In accordance with the invention, there is provided an improved concrete form having a concrete form liner of laminated construction. The form liner comprises a porous fabric having a drainage scrim laminated to one side thereof.

The drainage scrim is laminated directly to one side of the porous fabric by suitable lamination means known in the lamination art. For example, lamination can be accomplished by extruding the drainage scrim directly onto the porous fabric right after fabric quenching so that no adhesives are required. Alternatively, hotmelts or suitable adhesives may be used to accomplish lamination between the porous fabric and the drainage scrim.

The porous fabric used may be as disclosed in U.S. Pat. No. 5,135,692, or may be of special construction as disclosed in U.S. Pat. No. 5,124,102, the entire contents of each patent being incorporated herein by reference. Preferably, the fabrics of U.S. Pat. No. 5,124,102 are used, such fabrics having a different range of pore sizes on one side of the fabric compared to the opposite side of the fabric. Such fabrics are commercially available under the trademark "ZEMDRAIN" from E. I. du Pont de Nemours, S.A., Luxembourg.

As used herein, the term "drainage scrim" means a mesh or netted structure having a thickness of between 1–6 mm, preferably at least 2 mm, and non-compressible at a pressure of less than 2 megabars. The netting must have between 40–90% open space to provide for drainage (e.g., large openings formed by thick filaments or polymer branches). Preferably, the drainage scrim has multi-directional, or at least bi-directional, drainage channels with at least 0.2 mm uncompressed free space between channels available for water to pass through during drainage. Preferably, the netting has a basis weight of between 200–2000 g/m$^2$ and is fabricated of a polyolefin material, such as polyethylene or polypropylene. A particularly preferred drainage scrim is disclosed in U.S. Pat. No. 4,815,892 (Martin) and referred to as a "drainage core", the entire contents of which are incorporated herein by reference.

The laminated construction of the concrete form liner allows the porous fabric to keep substantially all concrete particles from entering therein while substantially enhancing the ability of the form liner to remove excess water from the surface of the concrete. In addition, the applicant has found that the laminated form liner can be successfully used in a concrete form without the need for form liner tensioning, an element necessary in the prior art.

In order for no form liner tensioning to be required (i.e., no folds during concrete pouring), the applicant has found it necessary that the laminated form liner have sufficient stiffness such that a 2 cm wide strip of the laminated form liner, hanging free over a length of 15 cm will need a weight of at least 15 grams placed at 2 mm from the free edge to bend the form liner so as to form an angle of 41 degrees with the plane on which the remainder of the strip is resting. This angle must be assumed within 30 seconds after the weight is applied to the strip. (This is a modified version of the DIN 53362 Method used for determining stiffness).

In one aspect, the invention provides for an improved concrete form for making concrete comprising:

(a) a support means; and (b) a porous form liner juxtaposed with, but not attached to, the support means, the improvement comprising the form liner comprising a porous fabric laminated to a drainage scrim to increase the draining effect of the form liner on any excess water present in the concrete, the form liner being untensioned and positioned such that the porous fabric side of the form liner contacts the concrete and the drainage scrim side of the form liner contacts the support means.

In another aspect, the invention also provides a process for making a concrete form by establishing a support with the shape desired for a concrete article to be made, and juxtaposing, but not attaching, a porous form liner to the support, the form liner comprising a porous fabric having a drainage scrim laminated to one side thereof and positioned such that the porous fabric side of the form liner contacts the concrete and the drainage scrim side of the form liner contacts the support.

As used herein, the term "juxtaposed" means that the form liner should be placed against the support means, but that the useful surface of one should not be bound or attached to the useful surface of the other. In other words, the form liner may be fixed in place over the support means by a few nails or staples on the edge or backside of the support means, but not bound or attached to the useful face of the support means.

As used herein, the "first side of the form liner" means the porous fabric side of the laminated form liner that is placed in direct contact with the wet concrete during casting.

As used herein, the "second side of the form liner" means the drainage scrim side of the laminated form liner which is placed in contact with the support of the concrete form.

BRIEF DESCRIPTION OF THE DRAWINGS

The invention will be better understood with reference to the following figures.

DETAILED DESCRIPTION OF THE PREFERRED EMBODIMENTS

Figure 1:
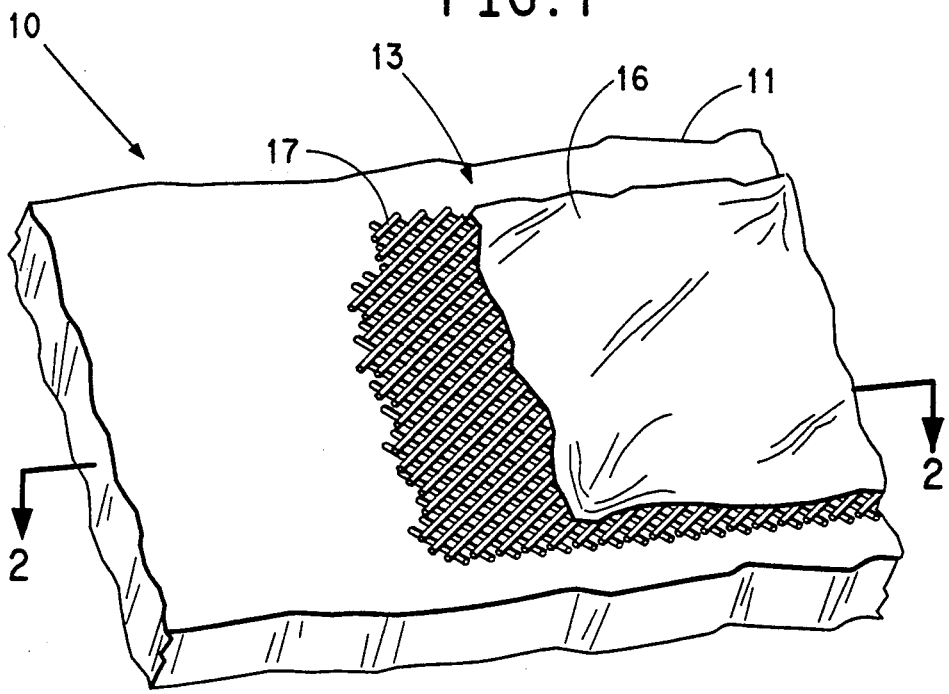
FIG. 1 is a representation of a concrete form, in partial section, with a support and the laminated form liner of the invention.

Referring now to the figures, wherein like reference numerals represent like elements, FIG. 1 shows a concrete form 10 including support 11 which can be of any material which has been traditionally used as a material for concrete forms. Support 11 must have enough strength to support the weight of the wet concrete before curing. The support can be made of wood or it can be of metal or plastic; and should be relatively smooth and flat. In addition, the support may have holes therethrough in order to assist in draining excess water from the concrete surface (see FIG. 4 for detail).

Figure 3:
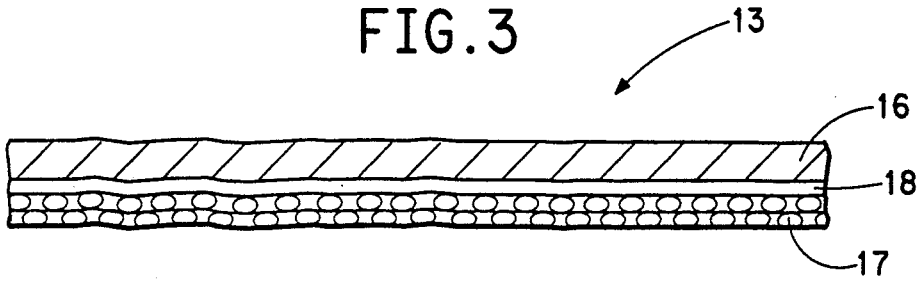
FIG. 3 is a cross-sectional view of the form liner illustrating the porous fabric and the drainage scrim laminated by an adhesive.

Laminated form liner 13 is comprised of a porous fabric 16 laminated to a drainage scrim 17 (see FIG. 3 for detail). Porous fabric 16 can be woven or nonwoven and can be made from natural or synthetic materials. The preferred material is a thermobonded polyolefin sheet material, such as polyethylene or polypropylene, having a basis weight of from about 70 to 600 g/m$^2$. However, other polymers can be used as a fabric material, such as PVC, polyester or any other polymer with sufficient chemical resistance when used in the basic environment of the fluid concrete. Preferably, the porous fabric 16 is treated or made in such a way that at least one side (i.e, the first side of the form liner) has a pore size of between 0.2 to 20 microns, preferably 0.5 to 10 microns. The range of pore sizes provided for the porous fabric 16 permits the passage of water and air, but prevents the passage of substantially all solid cement particles in the mix. The porous fabric 16 can be of any convenient thickness, but it must be adequate to withstand the high compaction pressures brought against it by the wet concrete. It is preferred that the porous fabric 16 should be at least 0.5 mm thick. Particularly preferred porous fabrics useful in the invention are disclosed in U.S. Pat. Nos. 5,135,692 and 5,124,102.

Lamination can take place by extruding the drainage scrim 17 directly onto the porous fabric 16 right before fabric quenching so that no adhesive is required. However, if this is not possible, normal lamination techniques (e.g., suitable adhesives or hotmelts) common to those skilled in the lamination art may be employed to accomplish the lamination.

Suitable drainage scrims according to the invention are commercially available under the tradename "TENSAR" from Netlon Limited of Blackbum, England and are disclosed as "drainage cores" in U.S. Pat. No. 4,815,892 (Martin).

Preferably, a hydrophilic finish is applied to the laminated form liner on the top so as to provide enhanced drainage where the concrete hydrohead pressure is lower. Ideally, the hydrophilic finish is applied on the concrete side of the form liner although this is not critical. In addition to improved drainage, the hydrophilic finish will also provide more uniform concrete color along the surface of the cured concrete.

Specific advantages of the inventive laminated form liner over form liners of the prior art include the following.

(1) The laminated form liner is insensitive to work site conditions (e.g., concrete too wet, excessive vibration or formwork vibration).

(2) The laminated form liner is sufficiently stiff such that there is no need to apply tension nor to have extensive fixation of the form liner in order to prevent folds during concrete pouring. A couple of nails or two-sided pressure sensitive tape will sufficiently fix the laminated form liner to the formwork. This results in less work on the job site, less training for workers, and less possibility for error.

(3) There is increased drainage (2–6 liters/$m^2$ direct capacity using the invention vs. 0.5 liter/$m^2$ using the prior art). This permits air to be evacuated while still using a hydrophilic finish on the laminated form liner. Much more water can be removed than with the prior art during periods of vibration and after vibration. Increased drainage causes a much greater effect in the concrete.

(4) There is no air trapped at 1–3 mm below the concrete surface. Trapped air can manifest itself if the concrete is sandblasted after curing.

(5) The laminated form liner can be cut to any dimension and the joints will barely be visible on the concrete surface.

(6) Easier and better water jet cleaning for multiple use (water stream through the product).

(7) Performance will be better and cost will be less than laminating a porous fabric of the prior art to another stiff material such as plywood.

Figure 2:
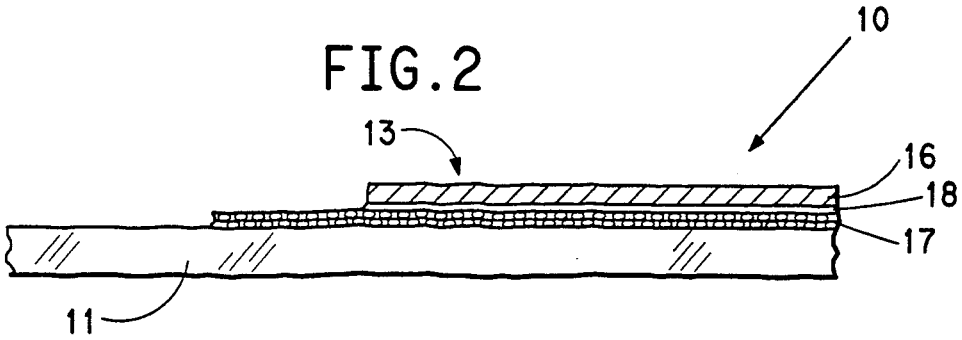
FIG. 2 is a cross-sectional view of the form from FIG. 1.

Referring now to FIG. 2, concrete form 10 is made by establishing a support 11 to have the shape desired in a final concrete article, and then juxtaposing form liner 13 with the support. The form liner 13 is untensioned and positioned such that the porous fabric 16 side of the form liner contacts the wet concrete and the drainage scrim 17 side of the form liner contacts the support (see FIG. 3 for more detail in form liner construction). Porous fabric 16 and drainage scrim 17 have been laminated together by adhesive 18 in this embodiment. The form liner 13 should not be closely affixed to support 11, but merely juxtaposed therewith. This can be effectively accomplished by using staples or small nails placed periodically at relatively large distances at the edge or backside of the form. It has been determined that the form liner should not be closely attached or bonded to the surface of the support. Thus, as noted before, the word "juxtaposed" means that the form liner 13 should be placed against support 11; but that the surface of one should not be bound to the surface of the other. In use, water will pass through form liner 13 by being drawn away from the concrete surface and passing through the porous fabric 16 and then through the channels of drainage scrim 17.

Referring now to FIG. 3, the form liner 13 is shown in greater detail. In this figure, the porous fabric 16 is shown laminated by adhesive 18 directly to the drainage scrim 17.

Figure 4:
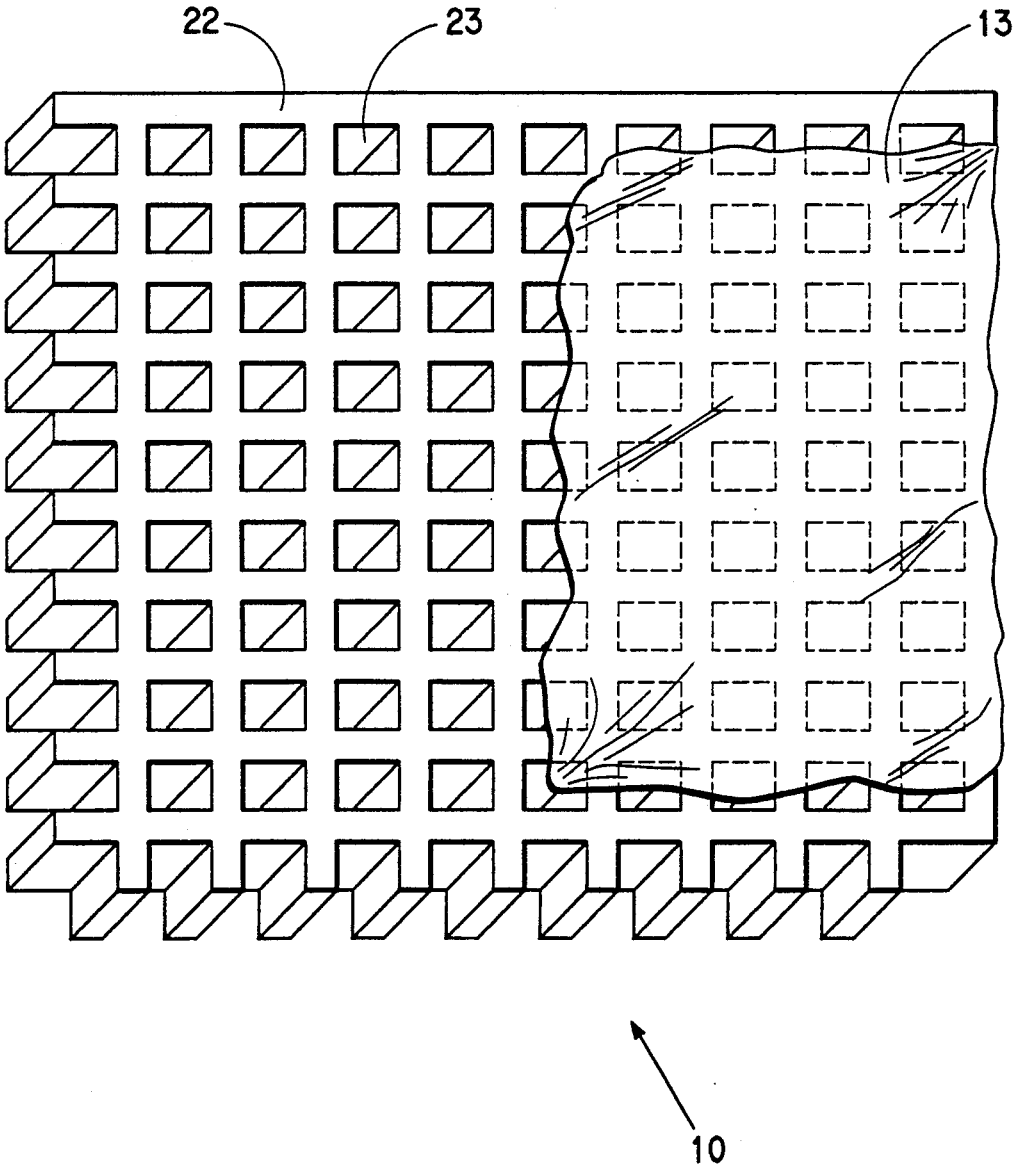
FIG. 4 is a representation of another form, in partial section, with a support having holes and the laminated form liner of the invention.

Referring now to FIG. 4, concrete form 10 includes support 22 with holes 23. (This demonstrates that it is also possible to practice the invention by using a support that has holes in addition to a flat smooth support). The holes in support 22 should be deep enough to assist the drainage scrim in the drainage of water from the concrete mix and preferably extend through the thickness of the support. The holes can be of any regular or irregular shape or size, and should be greater than about 0.25 $cm^2$ and less than about 2500 $cm^2$. In this embodiment, form liner 13 is juxtaposed with support 22 just as it was with support 11 shown in FIG. 1.

The improved form liner exhibits many advantages over the prior art. However, the major improvements include much better drainage of water and air from the concrete surface and the ability to form concrete without the need to tension the form liner. The form liner will remain useable for a much longer time than form liners of the prior art since large cement particles will tend not to plug up each given pore and build up a filter cake. Thus, the cement particles that pass through the first side of the form liner will tend to be washed back out and away with the excess water and air. As an added benefit, the concrete form can be dismantled sooner after pouring the concrete than forms of the prior art.

EXAMPLES

The inventive form liner and form liners of the prior art will be further described and compared by reference to the following non-limiting examples. All percentages are by weight unless otherwise indicated.

EXAMPLE 1

The effect of drainage on cement particles was demonstrated by showing the depth affected by drainage at different vibration levels. Tests were run for a concrete with a water/cement ratio (w/c) of 0.5 (about 0.1 higher than optimum). The concrete wall was 30 cm thick. As shown in Table 1, this clearly affects the concrete depth affected by the vibration. In the Table, the porous fabric used was uncoated "ZEMDRAIN" from E. I. du Pont de Nemours, S.A. Luxembourg. In one case, small holes were made in the support plate in order to increase drainage.

TABLE 1

| Porous Fabric | Plate | Vibration | Water Removed | Concrete Depth Affected |
|---|---|---|---|---|
| ZEMDRAIN | full board | 30 sec/$m^2$ | 0.7 l/$m^2$ | 4–8 mm |
| ZEMDRAIN | full board | 90 sec/$m^2$ | 1–1.5 l/$m^2$ | 12–15 mm |
| ZEMDRAIN | holes 10 cm apart | 90 sec/$m^2$ | 2.0 l/$m^2$ | 20–30 mm |

EXAMPLE 2

In this example, the surface hardness of the resulting concrete was measured for forms using the inventive form liner (B & D) and for forms using prior art fabrics (A & C). In all cases the vibration applied was 90 sec/$m^2$ and the concrete used was a type C45. The concrete wall was 20 cm thick. The surface hardness was measured after 24 hours using a Hammer Schmidt tester. The results are presented in Table 2 below.

TABLE 2

| Porous Fabric | Water/Cement | Water Removed | Surface Hardness |
|---|---|---|---|
| (A) ZEMDRAIN | 0.41 | 0.39 l/$m^2$ | 34.0 |
| (B) ZEMDRAIN + NET | 0.41 | 0.96 l/$m^2$ | 36.0 |
| (C) ZEMDRAIN | 0.45 | 1.08 l/$m^2$ | 29.3 |
| (D) ZEMDRAIN + NET | 0.45 | 1.38 l/$m^2$ | 32.3 |

The results of Tables 1 and 2 indicate that vibration and drainage efficiency have a direct effect on the depth of the concrete affected by the use of porous formwork. The same is true for surface hardness and the color of the concrete (more uniform and darker).

Calculated Table

The drainage requirements were determined so as to achieve optimum chemical conditions for hydration (i.e., known in the concrete industry to be about w/c=0.4) on a concrete wall of 25 cm thickness, over the entire thickness. According to this determination, the amount of water to be removed should be as follows:

| | Excess Water for given Water/Cement ratio | | |
|---|---|---|---|
| Cement Content | w/c = 0.45 | w/c = 0.50 | w/c = 0.60 |
| 300 Kg/m$^3$ | 4 l/m$^2$ | 8 l/m$^2$ | 15 l/m$^2$ |
| 400 Kg/m$^3$ | 5 l/m$^2$ | 10 l/m$^2$ | 20 l/m$^2$ |
| 500 Kg/m$^3$ | 6 l/m$^2$ | 13 l/m$^2$ | 25 l/m$^2$ |

Comparing the amount of water removed from the surface of the concrete in the above tests to the amount of calculated excess water, and considering the improvement in concrete properties achieved by more efficient concrete drainage, it becomes clear that the laminated form liner of the invention provides better quality concrete.

Considering the limited vibration time available (to avoid de-mixing of the concrete) and hydraulic factors, the applicant believes that the drainage scrim has to have a thickness of at least 1 mm and have at least 40% open space in order to allow sufficient dynamic water flow during vibration. This means that there should be about at least 0.2 mm average free space for drainage between the concrete surface and the formwork.

Although particular embodiments of the present invention have been described in the foregoing description, it will be understood by those skilled in the art that the invention is capable of numerous modifications, substitutions and rearrangements without departing from the spirit or essential attributes of the invention. Reference should be made to the appended claims, rather than to the foregoing specification, as indicating the scope of the invention.

I claim:

1. An improved concrete form for making concrete comprising:

(a) a support means; and (b) a porous form liner juxtaposed with, but not attached to, the support means, the improvement comprising the form liner comprising a porous fabric laminated to a drainage scrim to increase the draining effect of the form liner on any excess water present in the concrete, the form liner being untensioned and positioned such that the porous fabric side of the form liner contacts the concrete and the drainage scrim side of the form liner contacts the support means, the drainage scrim having a thickness of at least 1 mm and an open space of at least 40%, and the form liner having sufficient stiffness such that a 2 cm wide strip of the form liner having a thickness of at least 1.5 mm, having been stored or at least 16 hours at room temperature, hanging free over a length of 15 cm at room temperature, will need a weight of at least 15 grams, placed a 2 mm from the free edge of the form liner, to bend the form liner so as to form an angle of 41 degrees with the plane on which the remainder of the strip is resting within 30 seconds.

2. The concrete form of claim 1 wherein the support means is substantially smooth and flat.

3. The concrete form of claim 1 wherein the support means has holes of at least 0.25 cm$^2$ in area.

4. The concrete form of claim 1 wherein at least one side of the porous fabric has a pore size of between 0.2 to 20 microns.

5. The concrete form of claim 1 wherein the porous fabric is woven.

6. The concrete form of claim 1 wherein the porous fabric is nonwoven.

7. The concrete form of claim 6 wherein the nonwoven fabric is thermobonded polyolefin sheet material.

8. The concrete form of claim 7 wherein the polyolefin is selected from the group consisting of polyethylene and polypropylene.

* * * * *